United States Patent [19]

Cornish

[11] Patent Number: 4,925,330

[45] Date of Patent: May 15, 1990

[54] SIX-WAY CONNECTOR

[75] Inventor: John R. E. Cornish, Chislehurst, United Kingdom

[73] Assignee: S.G.B. Holdings Limited, Mitcham, England

[21] Appl. No.: 320,961

[22] Filed: Mar. 9, 1989

[30] Foreign Application Priority Data

Sep. 26, 1988 [GB] United Kingdom ..... 8822566

[51] Int. Cl.[5] ..... E04B 7/02

[52] U.S. Cl. ..... 403/171; 403/169; 403/174; 403/218; 403/178; 52/637

[58] Field of Search ..... 403/169, 170, 171, 177, 403/173, 174, 217, 218, 219, 178, 400; 52/637, 638, 645, 646, 648, 726; 182/179

[56] References Cited

U.S. PATENT DOCUMENTS 2,868,568 1/1959 Frye ..... 403/171
3,563,580 2/1971 Black ..... 403/172
4,231,198 11/1980 Augier et al. ..... 403/172 X
4,271,654 6/1981 Jungbluth ..... 403/172 X
4,562,681 1/1986 Smith ..... 52/637 X

FOREIGN PATENT DOCUMENTS 2592921 7/1987 France ..... 403/174

*Primary Examiner*—Randolph A. Reese
*Assistant Examiner*—Franco S. Deliguori
*Attorney, Agent, or Firm*—Arnold, White & Durkee

[57] ABSTRACT

A six-way connector, for use with structural formwork elements, comprises an upper plate a lower plate and four vertical plates extending therebetween. Each plate is provided with a plurality of apertures to enable a structural formwork element to be secured to the respective plate. At least two of the plates are provided with apertures to receive bolts from the structural formwork element so that the plates may have one structural formwork element centrally connected thereto, or two structural formwork elements connected thereto in side-by-side relationship.

12 Claims, 3 Drawing Sheets

1
2
3
4
5
6
7
8
9
10
11
12
13
14
15
16
17
18

SIX-WAY CONNECTOR

BACKGROUND TO THE INVENTION

The present invention relates to a six-way connector and more particularly relates to a six-way connector intended for use with elongate formwork elements known as "soldiers". Specifically, a "soldier" is an elongated structural formwork element having rectangular fixing plates provided at the opposing ends, each fixing plate providing four apertures for receiving bolts or the like. An exemplary soldier is shown in FIG. 2 (16).

SUMMARY OF THE PRIOR ART

It has been proposed previously to provide a six-way connector adapted to be utilized to secure together a number of soldiers which extend vertically above and beneath the connector and which extend horizontally to either side of the connector and to the front and to the back of the connector. It can be thus seen that the soldiers extend in six directions away from the connector.

Such connectors are often utilized in connection with a support structure for formwork.

The present invention seeks to provide an improved connector of this type.

BRIEF SUMMARY OF THE INVENTION

According to this invention there is provided a six-way connector, for use with soldiers said connector comprising an upper plate, and a lower plate and four vertical plates extending therebetween, each plate being provided with a plurality of apertures to enable a soldier to be secured to the respective plate, at least two of said plates being provided with a plurality of apertures to receive bolts from said soldiers such that said plates may have one soldier centrally connected thereto, or two soldiers connected thereto in side-by-side relationship.

Preferably, each of said at least two plates is so configured that it may receive a single soldier in a central position in either of two relative orientations;

Conveniently, each of the said at least two plates adapted to receive two soldiers in side-by-side relationship is provided with such apertures that the plate may receive said two soldiers in side-by-side relationship in each of two alternative relative orientations;

Preferably, said at least two plates comprise the upper plate and the lower plate;

Advantageously, each vertical plate is configured that it may receive a single soldier in either of two relative orientations;

Conveniently, each said vertical plate is associated with an extending part of the lower plate which forms a platform for supporting a soldier being connected to said vertical plate;

Preferably, each platform is associated with two laterally positioned upstanding webs, the webs being dimensioned to engage the sides of a soldier, presented to the plate, when the soldier is one relative orientation, and to support a soldier brought into engagement with said plate when the soldier is in another relative orientation;

Conveniently, a plurality of said plates are provided with one or more apertures therein adapted to receive tie rods extending axially of the soldier or soldiers connected to the said plate; and Preferably, the plates are held in their relative positions by means of a cruciform web.

The invention also relates to a formwork arrangement incorporating one or more six-way connectors as described above and a plurality of soldiers.

BRIEF INTRODUCTION OF THE DRAWINGS

DESCRIPTION OF PREFERRED EMBODIMENTS

Figures 1, 2:
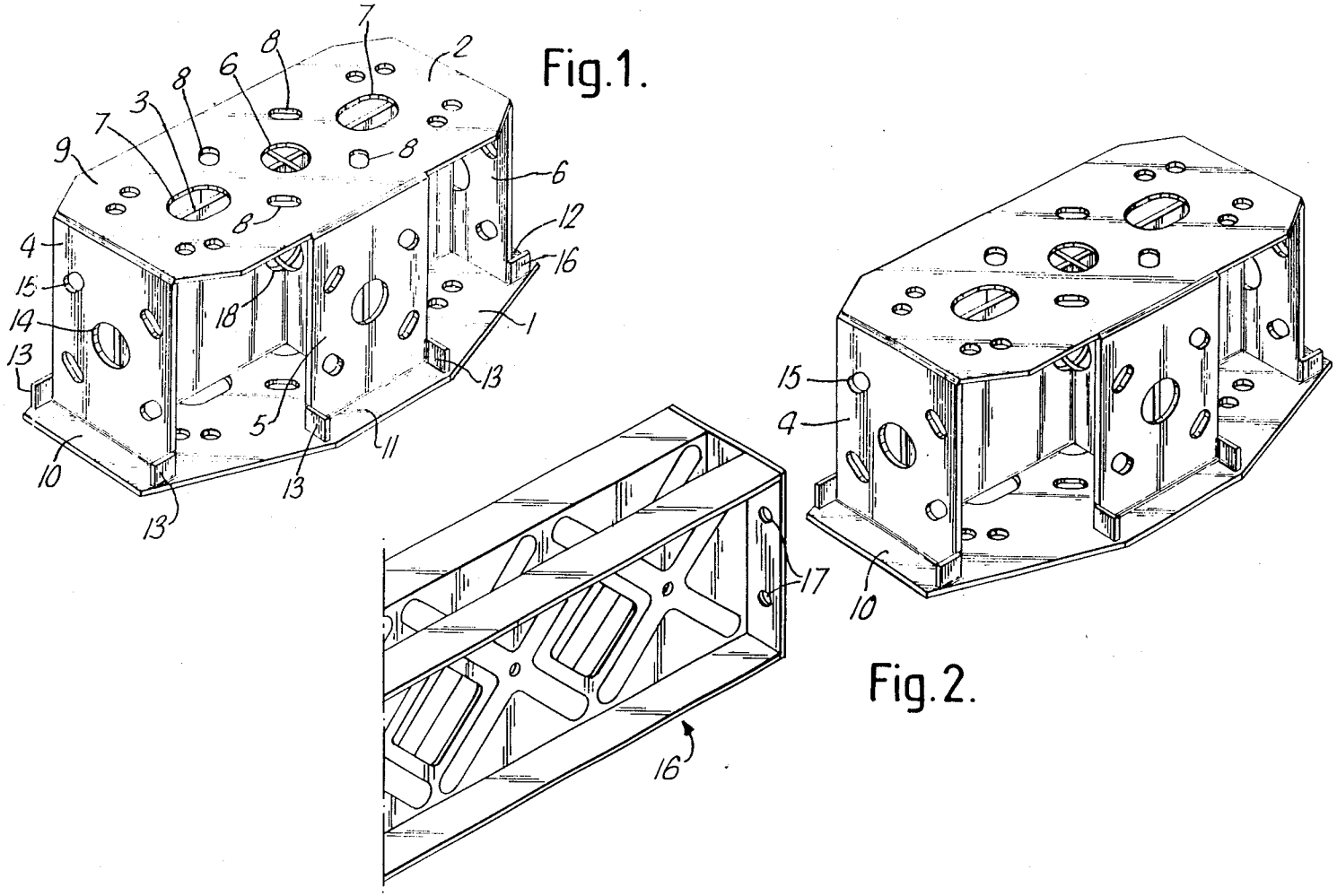
FIG. 1 is a perspective view of a connector in accordance with the invention.
FIG. 2 is a perspective view illustrating a soldier being brought into mating engagement with the connector of FIG. 1.

Referring now to FIG. 1 of the accompanying drawings a six-way connector in accordance with the present invention comprises a lower horizontal plate 1 and an upper horizontal plate 2 located at a position above the lower plate 1. The plates 1 and 2 lie in parallel planes. The plates 1 and 2 are maintained in a spaced apart condition by a cruciform vertical web 3 located between the plates 1 and 2, and by four vertical face plates only three of which 4, 5, 6 are illustrated in FIG. 1. The fourth face plate corresponds to the visible plate 5. The described structure is symmetrical.

It is to be observed that the lower horizontal plate 1 has a greater width and a greater length than the upper horizontal plate 2.

The upper plate 2 is of generally rectangular form and is provided with a central aperture 6. Located towards each end of the plate is a further oval aperture 7 located on the central axis of the plate. The end of the aperture 7 towards the central aperture 6 is associated with two generally radially disposed elongate apertures 8, which are located adjacent, but spaced from, the aperture 7. Two further pairs of round apertures 9 are provided adjacent but spaced from the ends of the upper plate 2.

The lower horizontal plate 1 has a similar pattern of apertures to that described with reference to the upper plate 2, but, because it is longer and wider than the upper plate 2, the lower plate 1 is of a generally lozenge shape.

The vertical plates 4, 5 and 6 each extend vertically between a free edge of the upper plate 2 and the lower plate 1. Because the lower plate 1 is larger than the upper plate 2, each vertical plate 4, 5, 6 abuts the lower plate 1 at a position spaced inwardly from the free edge of the lower plate 1. Thus platform areas 10, 11, 12 are created defined by that part of the lower plate 1 adjacent the lower edge of each of the vertical plates 4, 5, 6. Each platform region is bounded by two upstanding vertical webs 13 located adjacent the base of the vertical plates 4, 5 and 6 and extending perpendicularly thereto. The webs 13 are aligned with the vertical edges of the plates 4, 5 and 6.

Each vertical plate 4, 5, 6 is provided with a central circular aperture 14 which is surrounded by four generally targentially inclined oval apertures 15.

Referring now to FIG. 2 a soldier 16, which is a well-known item per se can be brought into engagement with the described six-way connector to extend horizontally therefrom. It can be seen that the end of the soldier that is to be engaged with the six-way connector may be rested upon the platform 10. When the soldier rests on the platform 10 apertures 17 formed in the end plate of the soldier are aligned with the oval apertures 15 formed in the vertical plate 4 and appropriate nuts and bolts may be used to secure the soldier to the end plate 4. There are four apertures 17. They do not, however, lie on the corners of a notional square, but instead lie on the corners of a notional rectangle. It is to be appreciated that whilst the soldier 16 has been shown being brought into engagement with the six-way connector in one orientation, the soldier may be rotated through 90° about its horizontal axis and may be still brought into engagement with the six-way connector. In this condition the end of the soldier will rest on top of the webs 13, and the arrangement is such that the apertures 17 are still being aligned with the oval apertures 15. It is for this reason that the oval apertures 15 are oval and have an axial extent, since the apertures 17 formed in the end plate of the soldier are not totally symmetrically located.

Whilst a soldier has been described being brought into engagement with the vertical plate 4 it will be readily appreciated that since the plates 5 and 6 are of the same design and each have an associated platform region, with associated webs 13 exactly the same technique may be utilized to bring a soldier into engagement with any one of the vertical plates 4, 5, 6 as described above.

The web portions 13 serve to prevent the soldier sliding from side-to-side relative to the six-way connector before the bolts have been inserted in position through the apertures 17 in the end plate of the soldier and the oval apertures formed in the vertical plate of the six-way connector, when the soldier is in one relative orientation, and serve to support the soldier with the apertures 17 in alignment with the apertures in the vertical plate in another relative orientation.

As will later be explained, the end plates of each soldier are generally rectangular in shape and thus define an elongate axis parallel to the longer side of the end plate. A reference axis may be associated with each vertical plate extending from the upper plate through to the lower plate. In this fashion the relative orientation in which the web portions 13 prevent side-to-side sliding of the soldier may described as having the elongate axis of the soldier parallel to the reference axis of the vertical plate. In a like manner, when the reference axis of the vertical plate is perpendicular to the elongate axis of the soldier, the soldier will be supported by the web portions 13.

It will be appreciated that the central aperture 6 and the oval apertures 8 formed in the upper plate 2 (and in the lower plate 1) of the six-way connector have precisely the same relative size and configuration as the aperture 14 and the oval apertures 15 as described with reference to the vertical plate 4. It will thus be appreciated that a soldier may be brought into engagement with the central part of the upper plate 2, and the central part of the lower plate 1 and may be secured in position by means of bolts passing through the end plate of the soldier and passing through the oval apertures 8 formed in the upper plate 2 and the lower plate 1 of the six-way connector as shown in FIG. 1. The soldiers may be in either of two relative orientations.

It is to be appreciated that the end plate of each soldier is preferably of a rectangular form, rather than a square form. Thus each end plate presents an elongate axis which is parallel with the longer sided of the end plate. It will also be appreciated that the upper plate and the lower plate are each also of generally rectangular shape, thus presenting an elongate axis. The soldiers may be connected to the upper plate or the lower plate with the elongate axis defined by the end plate of each soldier parallel with the elongate axis of the upper or lower plate. In an alternate orientation, the soldiers may be connected to the upper plate or the lower plate with the elongate axis of the end plate of the soldier extending transversely or perpendicularly to the axis of the top or bottom plate.

Figure 3:
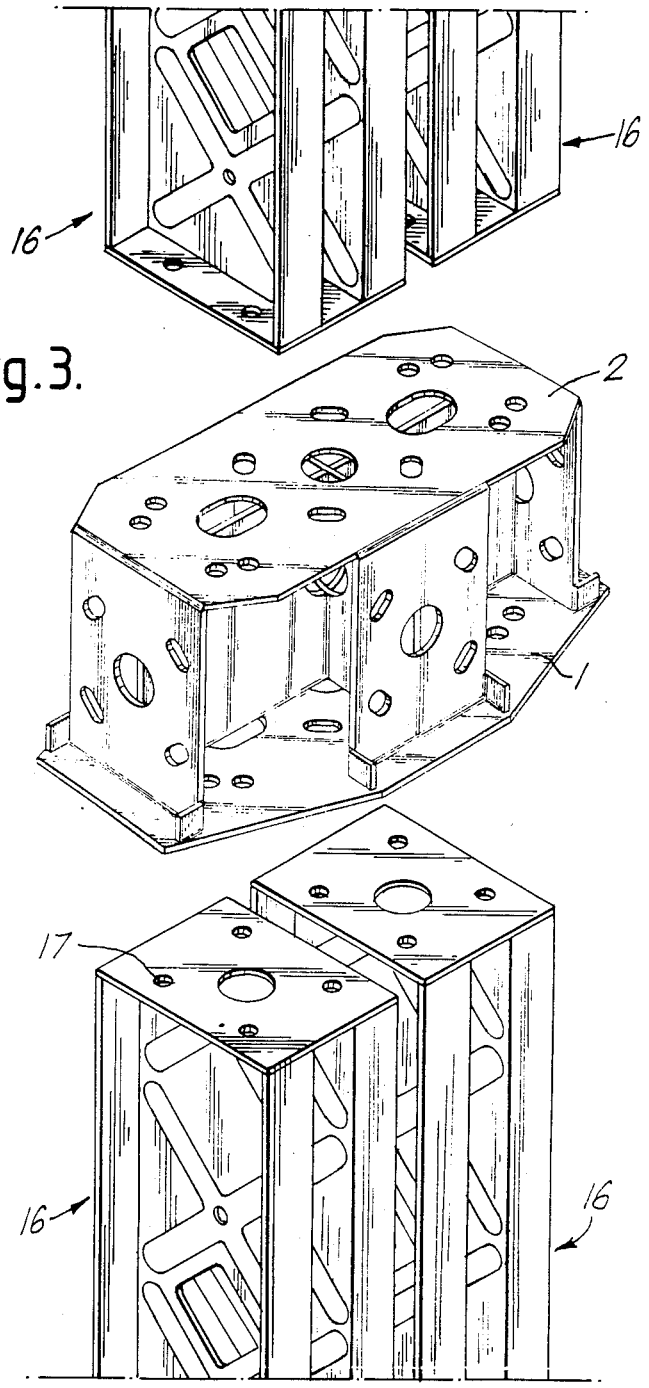
FIG. 3 is a further corresponding view illustrating four soldiers being brought into engagement with the connector of FIG. 1.

However, the six-way connector of the present invention is provided with further apertures formed in the upper plate 2, and the lower plate 1, these further apertures being provided so that, as shown in FIG. 3, two soldiers 16 may be connected to the upper plate 2 and two further soldier 16 may be connected to the lower plate 1, with the soldiers being in a side-by-side parallel relationship. In this case the apertures 17 formed in the end plate of each soldier will be aligned either with one of the oval holes 8 or with one of the round holes 9. The central aperture in the end plate of the soldier will be aligned with the aperture 7.

Figure 4:
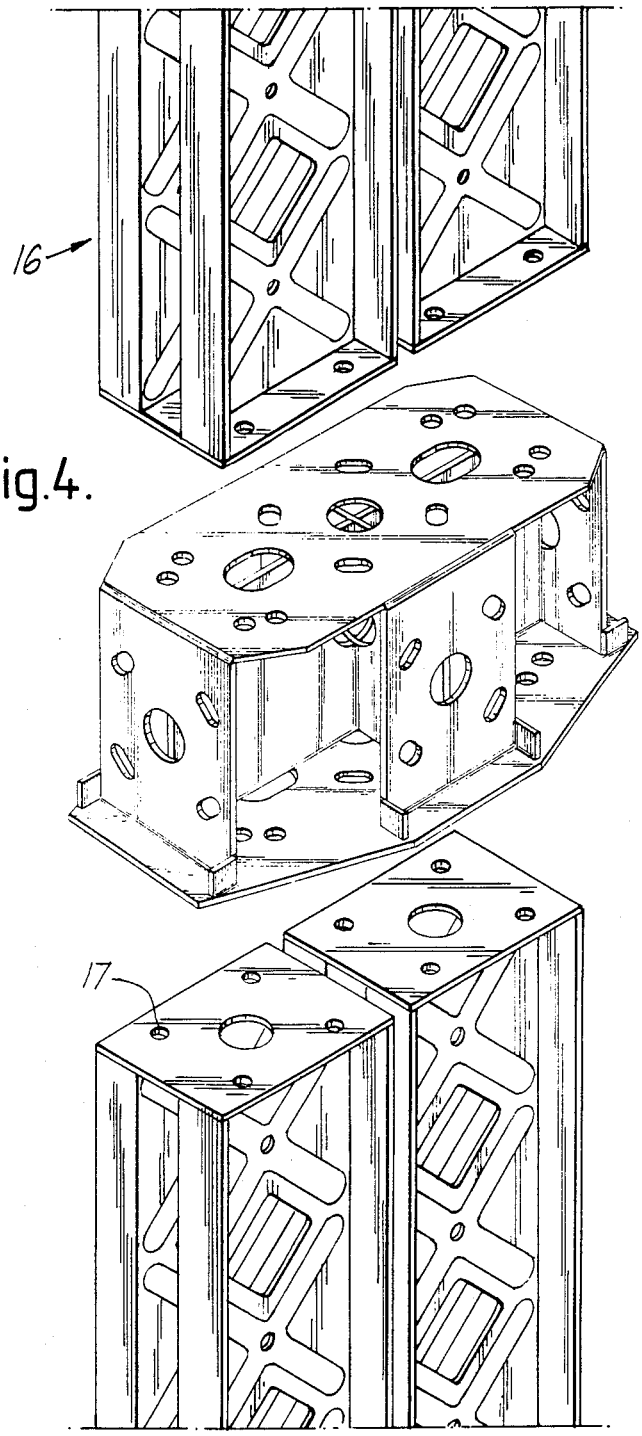
FIG. 4 is a further view, corresponding to FIG. 3, and again showing four soldiers being brought into engagement with the connector of FIG. 1.

Whilst FIG. 3 illustrates two soldiers connected to the upper plate 2 and two soldiers being connected to the lower plate 1 in one relative orientation it is to be appreciated that the soldiers to be connected to the upper plate 2 and the lower plate 1 may have an alternative relative orientation, as illustrated in FIG. 4, whilst still being in a side-by-side relationship. In this case some of the apertures 17 in the end plates of the soldiers are aligned with the other one of the two round apertures 9.

The apertures 6, 7 and 14 are provided so that tie rods may pass completely through the six-way connector to enable the entire structure to be tensioned thus increasing the strength of the resultant structure. An appropriate aperture 18 is also provided at the centre of the cruciform web 3 for this purpose.

From the description provided above it will be appreciated that the six-way connector of the invention enables various structures to be fabricated. The six-way connector is able to receive either one or two soldiers in at least two directions, thus enabling the strength of the structure to be selected in accordance with the load carrying capacity required. In all six directions soldiers can be fixed to the six-way connector in two different relative orientations. This provides a great degree of flexibility when designing a structure to be fabricated from soldiers and six-way connectors. Where each soldier joins the connector, regardless of the orientation of the soldier and regardless of the number of soldiers connected to the connector in any one direction, an aperture is provided to allow a tie rod passing through the soldier to pass also through the six-way connector. Finally the bottom plate of the connector is extended to provide means to support each horizontal soldier whilst it is being connected to the six-way connector, thus making assembly easier. Each platform is associated with vertical webs which serve to prevent the soldier from moving from side-to-side when the soldier is in one relative position, and which support the soldier when the soldier is in the other relative position, so that the central axis of the soldier is still aligned with the central aperture formed through the vertical plate.

Whilst the six-way connector has been described in the orientation in which it will normally be used, the connector may be used in other orientations if desired.

Whilst the invention has been described, by way of example, with reference to preferred embodiments thereof it is to be appreciated that many modifications may be effected to the invention without departing from the scope of the invention as defined by the following Claims.

What is claimed is:

1. A six-way connector for securing together structural formwork elements, said connector comprising:

an upper, generally rectangular plate and a lower, generally rectangular plate secured together in a planar spaced relation by at least four vertical plates so as to form a rigid structural unit, both upper and lower plates having an elongate axis extending lengthwise through said rigid structural unit, said elongate axis parallel to both upper and lower plates, each of said vertical plates having an elongate axis extending from the top plate to the bottom plate, each of said plates having a generally planar contact surface for connecting a formwork element in an abutting relation thereto, each of said plates having a plurality of aperture means so as to enable the connection of a formwork element centrally thereto, at least two of the plate having further aperture means to enable the connection thereto of two formwork elements in a side-by-side relationship.

2. A six-way connector according to claim 1 wherein one of the said at least two plates having further aperture means is adapted to receive two structural formwork elements, each structural formwork element having a generally rectangular end plate with an elongate axis, in a side-by-side relationship whereby the elongate axis of each of said two end plates is either parallel or perpendicular to the elongate axis of said plate.

3. A six-way connector according to claim 1 wherein said at least two plates having further aperture means comprise the upper plate and the lower plate.

4. A six-way connector according to claim 1 wherein at least one vertical plate is so configured that it may receive a single structural formwork element, said structural formwork element having a generally rectangular end plate with an elongate axis, in a manner whereby the elongate axis of said structural formwork element is either parallel or perpendicular to the elongate axis of said at least one vertical plate.

5. A six-way connector according to claim 1 wherein each of said vertical plates is associated with an extending part of the lower plate which forms a platform for supporting a structural formwork element being connected to said vertical plate.

6. A six-way connector according to claim 5 wherein each platform is associated with two laterally positioned upstanding webs, the webs being dimensioned to engage the sides of a structural formwork element, said structural formwork element having a generally rectangular end plate with an elongate axis, when the structural formwork element is in a position whereby the elongate axis of the structural formwork element is parallel with the elongate axis of said vertical plate.

7. The six-way connector of claim 5 wherein each platform is associated with two laterally positioned upstanding webs, the webs being dimensioned to support a structural formwork element having a generally rectangular end plate with an elongate axis, when said structural formwork element is positioned whereby the elongate axis of the structural formwork element is perpendicular to the elongate axis of said vertical plate.

8. A six-way connector according to claim 1 wherein a plurality of said plates are provided with one or more apertures therein adapted to receive tie rods extending axially of the structural formwork element or elements connected to the plate.

9. A six-way connector according to claim 1 wherein the plates are held in their relative positions by means of a cruciform web.

10. The six-way connector according to claim 1 wherein one of said at least two plates having further aperture means is so configured that it may receive a single structural formwork element having a generally rectangular end plate with an elongate axis in a central position with the elongate axis of the structural formwork element extending either perpendicularly or in parallel with the elongate axis of said one of said at least two plate having further aperture means.

11. The six-way connector of claim 1 wherein each vertical plate is provided with a centrally disposes central aperture which is surrounded be four generally tangentially inclined oval apertures.

12. The six-way connector of claim 1 wherein both the upper and the lower plates are provided with a centrally disposed aperture.

* * * * *